US005522606A

United States Patent [19]

Pressley et al.

[11] Patent Number: 5,522,606

[45] Date of Patent: Jun. 4, 1996

[54] RETAINER FOR A PNEUMATIC TOOL

[75] Inventors: Jack Pressley, Hudson, Ohio; David M. Young, Frankfort, N.Y.; John Knott, New Hartford, N.Y.; Thomas Wastowicz, Little Falls, N.Y.

[73] Assignee: Chicago Pneumatic Tool Company, Utica, N.Y.

[21] Appl. No.: 301,656

[22] Filed: Sep. 7, 1994

[51] Int. Cl.[6] ..... B25D 17/08

[52] U.S. Cl. ..... 279/91; 173/132; 279/19.6; 403/348; 403/375; 403/383

[58] Field of Search ..... 279/89–91, 93, 279/19–19.3, 19.5–19.7; 403/348, 349, 375, 383; 173/132

[56] References Cited

U.S. PATENT DOCUMENTS

| | | | |
|---|---|---|---|
| 802,303 | 10/1905 | Murphy . | |
| 1,368,889 | 2/1921 | Bullard | 279/91 |
| 1,968,380 | 7/1934 | Curtis . | |
| 2,511,416 | 6/1950 | Rundorff | 279/89 |
| 3,010,730 | 11/1961 | Fuehrer | 279/19 |
| 4,174,113 | 11/1979 | Eckman | 279/19.4 |
| 4,545,440 | 10/1985 | Treadway | 173/132 |
| 5,170,560 | 12/1992 | Allemann et al. | 30/228 |

FOREIGN PATENT DOCUMENTS

| | | | |
|---|---|---|---|
| 1073410 | 1/1960 | Germany . | |
| 696639 | 9/1953 | United Kingdom | 279/93 |

*Primary Examiner*—Steven C. Bishop
*Attorney, Agent, or Firm*—Schmeiser, Olsen & Watts

[57] ABSTRACT

A retainer for a pneumatic tool and assembly therefor is disclosed. The retainer includes a tool body having an internal surface defining a bore and an external surface having a threaded portion. A retainer cap is used with the tool body and includes an internal surface having a threaded portion adapted to engage the threaded portion of the tool body. An insert having an outer surface is rotatably mounted in the retainer cap. The insert includes an inner surface with a first inner surface portion adapted for conforming with a non-circular lug surface of a tool shank and a second inner surface portion radially offset from the first portion adapted for conforming with the non-circular lug surface.

12 Claims, 3 Drawing Sheets

10
16
17
38
21
40
44
42
30
31
22
4
14
33
32
35
20
36
46
12
48
7
39
47
34
63
61
65
62
50
23
24
3
6

RETAINER FOR A PNEUMATIC TOOL

FIELD OF THE INVENTION

The present invention relates generally to pneumatic tools. In particular, the present invention is concerned with a retainer for a pneumatic tool.

BACKGROUND OF THE INVENTION

Heretofore, various types of retainers have been used in conjunction with pneumatic and other power tools. U.S. Pat. No. 4,174,113 to Eckman discloses a bit retainer for pneumatic tools arranged to releasably receive a bit. The retainer includes a body having a nose portion of generally elliptical configuration, a center portion of circular configuration and a rear portion of generally elliptical configuration that has its major axis disposed at about 90° relative to the major axis of the front portion of the bore. Radially moveable locking members are provided that operate in cooperation with a moveable sleeve. The sleeve is movable between unlatched and latched positions to permit and prevent radial movement of the locking members to positively retain the bit unless the sleeve is intentionally moved to the unlatched position.

German Auslegeschrift 1,073,410 shows a retainer for a pneumatic tool which has elongated slots and a tool with flanges which fit therein.

U.S. Pat. No. 1,968,380 to Curtis discloses a lug chuck for rock drills. The shank of the drill is rotatably mounted within the front end of the front housing bore. A chuck is formed with a plurality of a opposed clutch jaws capable of cooperation with the sleeve clutch jaws to lock the two parts against relative rotation. The unbroken portion of the chuck is formed with a slot opening into the base of the jaws. This slot is properly machined to permit the passage of the shank and lug of the drill steel.

U.S. Pat. No. 5,170,560 to Allemann et al. discloses a hand nibbling machine which has a manipulatable housing with a drive head in which there is a downwardly opening passage. The upper portion of the tool assembly is releasably engaged in the passage of the drive head by interengaging surfaces. See FIGS. 7–17 for various types of interengaging surface.

U.S. Pat. No. 802,303 to Murphy discloses a pneumatic hammer. The pneumatic hammer of Murphy discloses an inner section of engaging left threads of the cylinder and interior right threads engaging right threads of the cylinder. This reference discloses the use of a threaded retainer for pneumatic tool.

U.S. Pat. No. 4,545,440 to Treadway also discloses a threaded retainer for a pneumatic tool. The attachment is in the form of a housing which receives a punch and a punch holder and can be screwed on the muzzle end of a pneumatic hammer.

The above related art summaries are merely representative of portions of the inventions disclosed in each reference. In no instance should these summaries substitute for a thorough reading of each individual reference. All the references mentioned herein are hereby incorporated by reference.

One of the difficulties not adequately addressed by the prior art is providing a threaded retainer cap for retaining a tool in a pneumatic tool body. After a tool is inserted into a tool body it is generally maintained in a rotationally fixed position relative to the tool body. Rotationally fixing the tool with respect to the tool body permits the operator to control the chisel cutting edge during operation.

During assembly of the tool into the tool body, a threaded retainer cap is rotated with respect to the tool body to secure the tool into the tool body. During this assembly, the tool must remain fixed with respect to the tool body. Thus, in accordance with the present invention a need arose to have a threaded retainer cap which allows the tool to remain rotationally fixed in the tool body and yet permits the retainer cap to be tightened on the tool body.

SUMMARY OF THE INVENTION

The present invention includes a threaded outer retainer cap which engages a threaded tool body and permits rotation of the retainer cap with respect to the tool body while the retainer cap fixes a tool to a tool body. The threaded retainer cap includes an insert with lug pockets therein. The insert is rotatable with respect to the retainer cap, and is retained in the cap by a round wire ring. The insert allows the retainer cap to be tightened on the tool body in a fully seated position with the tool locked with respect to the tool body, so that the tool does not rotate during operation.

BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENTS

Figure 1:
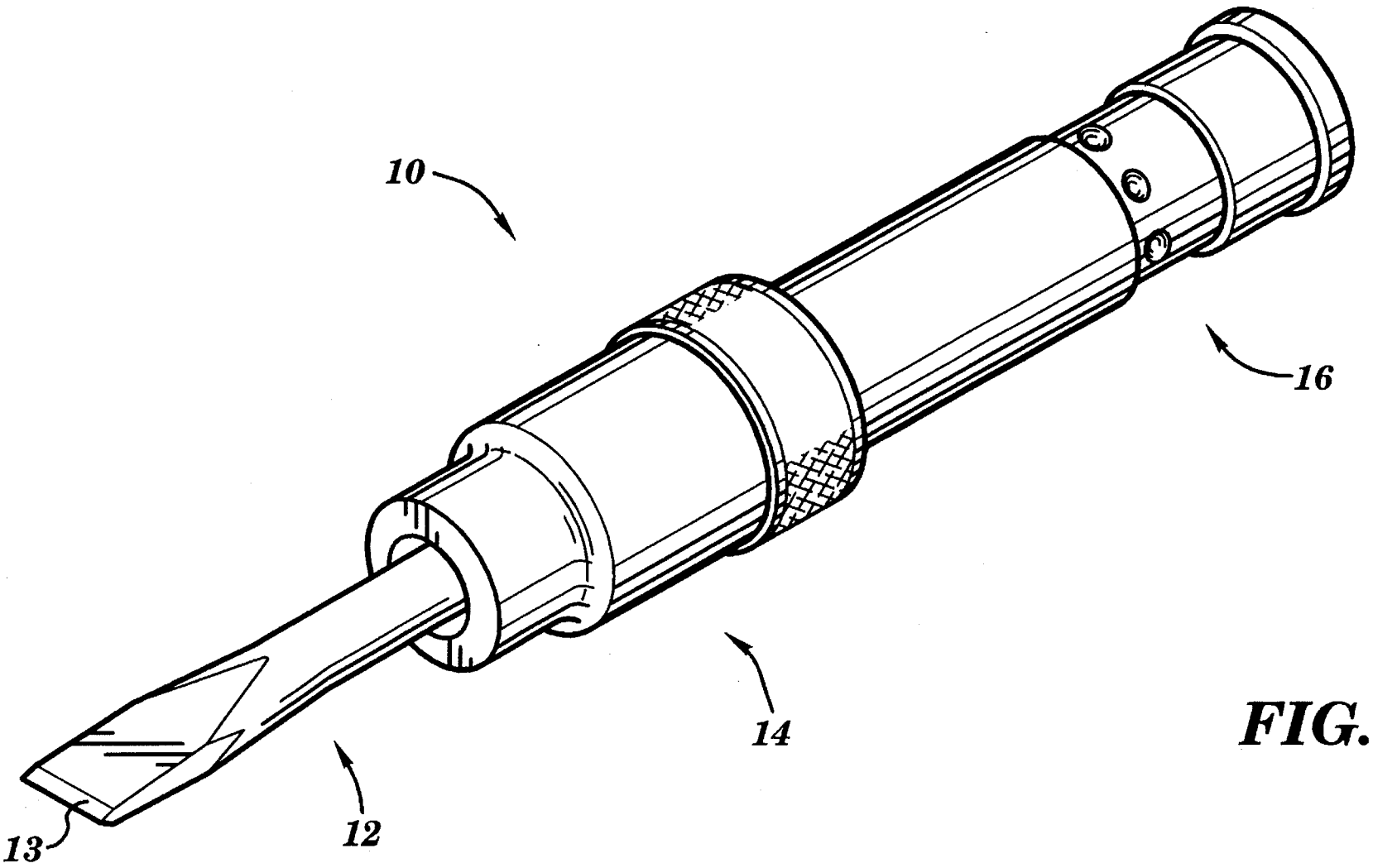
FIG. 1 is a perspective view of a pneumatic tool of the present invention.

Referring to FIG. 1, a pneumatic tool 10 is shown. The pneumatic tool 10 includes a tool body 16, a retainer cap 14 and a chisel 12 having a cutting edge 13 thereon.

FIGS. 2–8 show the pneumatic tool 10 having chisel 12 inserted therein. The chisel includes a shank 20 and elliptical flanges or lugs 23, 24 extending therefrom. The retainer cap 14 includes an outer section 30, a middle section 31, and an inner section 32. An insert 33 is positioned in the retainer cap 12.

Figures 2, 3, 5, 6:
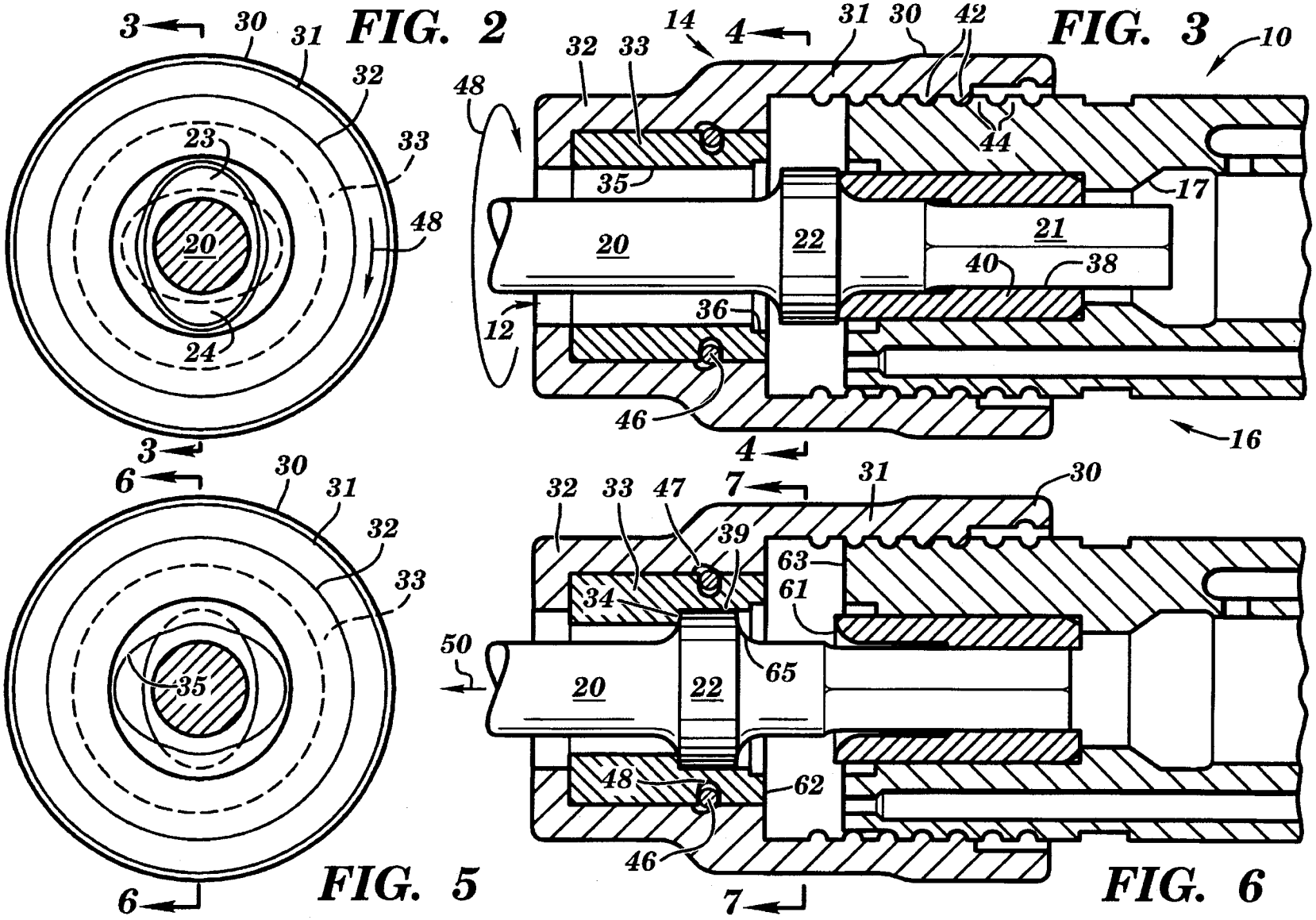
FIG. 2 is a front view of the retainer assembly of the present invention.
FIG. 3 is a sectional view through lines 3—3 of FIG. 2 of the retainer of the present invention.
FIG. 5 is a front view of the partially assembled retainer of the present invention as shown in FIG. 2 rotated 90°.
FIG. 6 is a sectional view through lines 6—6 of FIG. 5 of the present invention.
Figure 4:
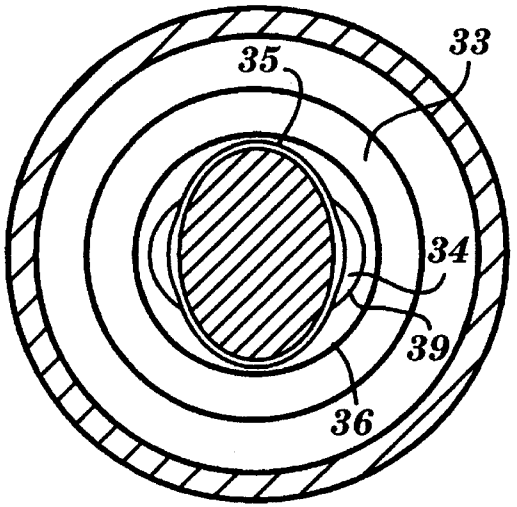
FIG. 4 is a sectional view through lines 4—4 of FIG. 3 of the retainer of the present invention.
Figure 7:
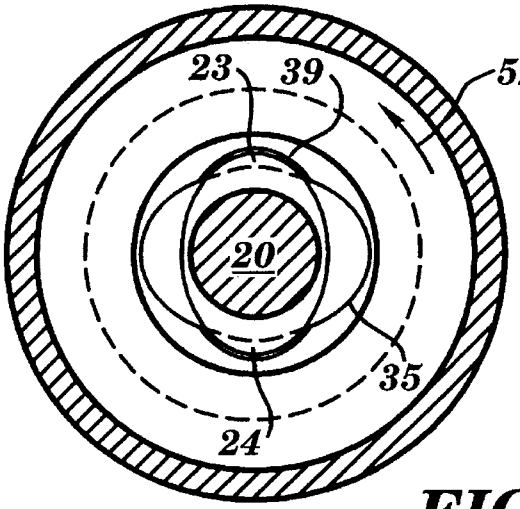
FIG. 7 is a cross-sectional view of lines 7—7 in FIG. 6 of the present invention.

Referring to FIG. 3, the oval collar 22 includes elliptical flanges or lug surfaces 23, 24. The oval or elliptical collar 22 is inserted into the retainer cap 12 through the insert 33 by conforming with an elliptical bore surface or the first inner surface portion 35. Although elliptical flanges 23, 24 are shown, other non-circular flanges and conforming inner surface portions may be used such as those disclosed in the aforementioned reference. The elliptical collar 22 has a close tolerance with respect to the first inner surface portion 35 and may not be rotated when inserted therein. The tool shank 20 includes a hex portion 21. The hex portion 21 engages with an internal surface 38 of tool body insert 40. The hex portion 21 and internal surface 38 may be formed of other types of interengaging surfaces such as splines. The tool body insert 40 has a tapered end and is press fitted into the internal surface 17 of the tool body 16.

The internal bore surface 38 of the hex bore insert 40 is stepped and includes an inner rounded surface 60. The end of the hex bore insert 40 is rounded at 61 to engage with an inner surface 65 of the elliptical collar 22. An external surface of the tool body 16 includes threads 44. The threads 44 are adapted to engage with threads 42 on an inner surface of the retainer cap 14. The threads 42 are located on an inner surface of the outer section 30 and middle section 31.

As shown in FIG. 3, the retainer 10 is assembled by first partially threading the retainer cap 14 onto the tool body 16. The tool 12 is then inserted into the retainer cap 14 by engaging the elliptical collar 22 with the first inner surface portion 35. After the elliptical collar 22 has been extended entirely through the first inner surface portion 35, directional arrow 48 shows the retainer cap 14 being rotated 90° with respect to the tool body 16 and tool 12.

Referring to FIG. 6, directional arrow 50 shows the tool shank 20 being pulled outwardly until the elliptical collar 22 is engaged with the elliptical second inner surface portion 39 and is seated on seat 34. Together, the first inner surface portion 35 and the second inner surface portion 39 define a stepped inner surface.

Figure 8:
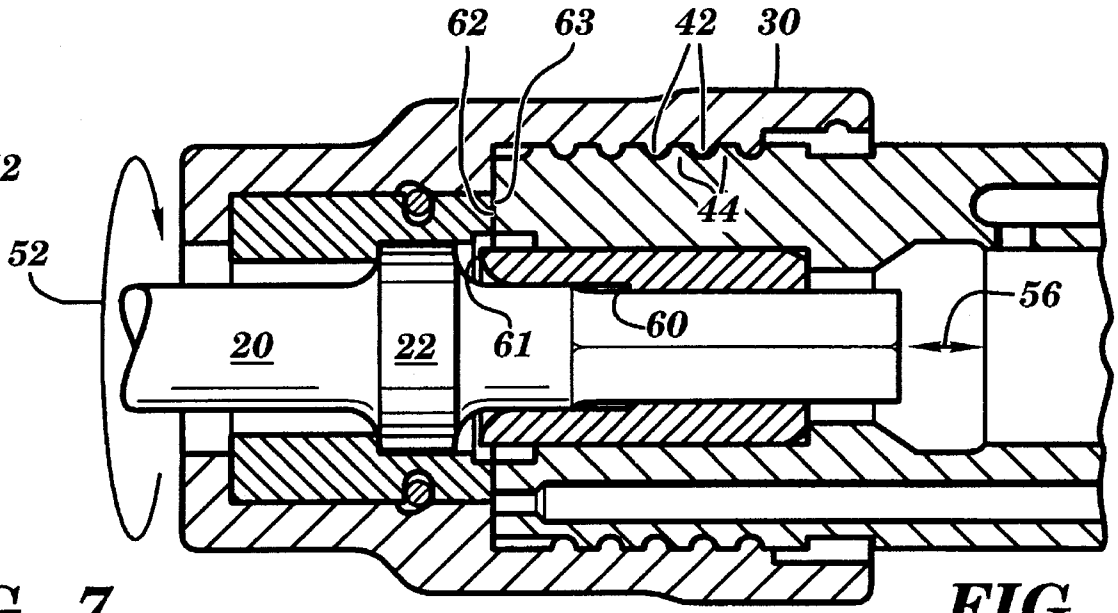
FIG. 8 is a sectional view of the retainer of the present invention in assembled form.

The retainer cap 14 is then threaded until it is tightened as shown in FIG. 8. As the retainer cap 14 is tightened until the base 62 of the insert 33 is seated against the end 63 of the tool body 16 as shown by directional arrow 52, the retainer cap 14 rotates with respect to the insert 33. The round wire ring 46 frictionally engages the insert 33 into the retainer cap 14. The retainer cap 14 has a cap pocket 47 which is offset from an insert pocket 48 for positioning the round wire ring 46 therein. Having the cap pocket 47 slightly offset from the insert pocket 48 has the advantage of locking the insert 33 into the retainer cap 14 by axially forcing the insert 33 into the retainer cap 14.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

What is claimed is:

1. A retainer for a pneumatic tool comprising:

a tool body having an internal surface defining a bore and an external surface having a threaded portion;

a retainer cap including an internal surface having a threaded portion adapted to engage the threaded portion of the tool body; and an insert having an outer surface rotatably mounted in said retainer cap and an inner surface with a first inner surface portion having a shape conforming with a non-circular lug surface of a tool shank and a second inner surface portion, radially offset from said first portion, having a shape conforming with said non-circular lug surface, said insert having 360° of free rotation within said retainer cap.

2. The retainer of claim 1, wherein the first inner surface portion extends substantially an entire axial length of the insert and the second inner surface portion includes a seat defined therein.

3. The retainer of claim 2, wherein the first inner surface portion and the second inner surface portion of said insert are elliptical and wherein said non-circular lug surface of said tool shank is elliptical.

4. The retainer of claim 1, further comprising a round wire ring disposed between said cap and said insert.

5. The retainer of claim 1, further comprising a tool body insert disposed in the bore of said tool body, said tool body insert having an outer surface portion adapted for conforming with the bore of said tool body and a stepped inner surface portion adapted for receiving said tool shank.

6. The retainer of claim 4, wherein the round wire ring is disposed in a pocket in the internal surface of the retainer cap and a pocket in the external surface of the insert, wherein said pockets are axially offset.

7. In combination, a retainer and a tool comprising:

a tool body having an internal surface defining a bore and a threaded portion;

a retainer cap including a threaded portion adapted to engage the threaded portion of the tool body;

a tool having a shank with a non-circular lug surface thereon; and an insert having an outer surface rotatably mounted in said retainer cap and an inner surface with a first inner surface portion adapted for conforming with said non-circular lug surface of a tool shank and a second inner surface portion, radially offset from said first portion, adapted for conforming with said non-circular lug surface, said insert having 360° of free rotation within said retainer cap.

8. The retainer of claim 7, wherein the first inner surface portion extends substantially an entire axial length of the insert and the second inner surface portion includes a seat defined therein.

9. The retainer of claim 8, wherein the first inner surface portion and the second inner surface portion of said insert are elliptical and wherein said non-circular lug surface of said tool shank is elliptical.

10. The retainer of claim 7, further comprising a round wire ring disposed between said cap and said insert.

11. The retainer of claim 7, further comprising a tool body insert disposed in the bore of said tool body, said tool body insert having an outer surface portion adapted for conforming with the bore of said tool body and a stepped inner surface portion adapted for receiving said tool shank.

12. A method for assembling a retainer for a pneumatic tool comprising:

providing a tool body having an internal surface defining a bore and a threaded portion, a retainer cap including a threaded portion adapted to engage the threaded portion of the tool body, a tool having a shank with a non-circular lug surface thereon; and an insert having an outer surface rotatably mounted in said retainer cap and an inner surface with a first inner surface portion adapted for conforming with said non-circular lug surface of a tool shank and a second inner surface portion radially offset from said first portion adapted for conforming with said non-circular lug surface;

engaging said non-circular lug surface of said tool with said first inner surface portion of said insert and inserting said tool through said first inner surface portion of said insert;

rotating said tool;

engaging said tool with said second inner surface portion of said insert; and threading said retainer cap on said tool body, whereby the retainer cap rotates about said insert and said insert is fixed with respect to said main tool body and said tool.

* * * * *